US010020610B2

(12) United States Patent
Suzuki

(10) Patent No.: US 10,020,610 B2
(45) Date of Patent: Jul. 10, 2018

(54) WATERPROOF CONNECTOR

(71) Applicant: Sumitomo Wiring Systems, Ltd., Yokkaichi, Mie (JP)

(72) Inventor: Masakazu Suzuki, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 15/658,481

(22) Filed: Jul. 25, 2017

(65) Prior Publication Data

US 2018/0048089 A1 Feb. 15, 2018

(30) Foreign Application Priority Data

Aug. 10, 2016 (JP) ..... 2016-157745

(51) Int. Cl.
*H01R 4/64* (2006.01)
*H01R 13/52* (2006.01)

(52) U.S. Cl.
CPC ..... *H01R 13/5219* (2013.01); *H01R 13/5213* (2013.01)

(58) Field of Classification Search
CPC ..... H01R 13/5277
USPC ..... 439/206, 205
See application file for complete search history.

(56) References Cited

U.S. PATENT DOCUMENTS 5,685,729 A * 11/1997 Reider ..... B60R 16/0238 439/206
6,113,407 A * 9/2000 Martin ..... H01R 13/521 439/205
8,257,101 B2 * 9/2012 Ichio ..... H01R 13/4367 439/206
8,366,466 B2 * 2/2013 Hashimoto ..... H01R 13/52 439/206

FOREIGN PATENT DOCUMENTS

JP 5768766 7/2015

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A waterproof connector includes a female housing (21) configured to form a sealing space (S) when connected to a male housing (11). The female housing (21) has an inner housing (22) with cavities (23) into which female terminal fittings (27) are to be inserted. The inner housing (22) is to be fit into a receptacle (13) of the male housing (11). A tubular fitting (35) of the female housing (21) surrounds the inner housing (22) and is fit to an outer periphery of the receptacle (13). A ventilation member (60) includes a ventilation film (61) enabling ventilation between the sealing space (S) and an outside of the female housing (21). The ventilation member (60) is arranged so that the ventilation film (61) at least partially overlaps the receptacle (13) in a virtual projection plane perpendicular to a connecting direction of the housings (11, 21).

6 Claims, 12 Drawing Sheets

WATERPROOF CONNECTOR

BACKGROUND

1. Field of the Invention

The invention relates to a waterproof connector.

2. Description of the Related Art

Japanese Patent No. 5768766 discloses a waterproof connector with a housing formed with cavities and a waterproof plug to be inserted into the cavity. The waterproof plug includes a tubular shaft and a ventilation film attached to one end part of the shaft. This connector can cause air to flow via the ventilation film while keeping the interior of the housing in a liquid-tight state when a pressure difference is generated between the interior of the housing and outside.

The cavity into which the waterproof plug is to be inserted is a space originally intended for a terminal fitting, and the waterproof plug is mounted utilizing the empty cavity. This eliminates the need to form a dedicated space for mounting the waterproof plug, and thus the housing can be miniaturized. However, the waterproof plug cannot be mounted if the empty cavity cannot be ensured in the housing.

The invention was completed based on the above situation and aims to attach a ventilation film without enlarging a housing.

SUMMARY

The invention is directed to a waterproof connector with a female housing configured to form a sealing space when connected to a male housing. The female housing has a terminal accommodating portion with cavities into which female terminal fittings are to be inserted. The female housing is to be fit into a receptacle of the male housing so that a tubular fitting of the female housing surrounds the terminal accommodating portion and fits to an outer periphery of the receptacle. A ventilation member overlaps at least part of the receptacle in a virtual projection plane perpendicular to a connecting direction of the male and female housings and includes a ventilation film that enables ventilation between the sealing space and an outside of the female housing.

According to this configuration, the ventilation member can be mounted into the female housing even if there is no empty cavity. Further, the ventilation member is arranged so that the ventilation film at least partially overlaps the receptacle in the virtual projection plane perpendicular to the connecting direction of the housings. Thus, a dedicated space to arrange the ventilation member in the virtual projection plane perpendicular to the connecting direction of the housings is small, and the ventilation film can be attached without enlarging the female housing.

The ventilation member may include a holding portion for holding the ventilation film in a direction intersecting the connecting direction. A tubular ventilation portion may extend from the holding portion and may communicate with the sealing space. A cross-sectional area of the tubular ventilation portion intersecting an extending direction may be smaller than the ventilation film. According to this configuration, even if the ventilation film is at a position distant from the sealing space, air can flow between the interior of the sealing space and the outside of the female housing through the tubular ventilation portion. Further, the cross-sectional area of the tubular ventilation portion is smaller than the ventilation film. Thus, the tubular ventilation portion can be arranged in a narrow part.

The tubular ventilation portion may extend substantially parallel to the connecting direction and at a position eccentric from a center of the ventilation film. Thus, the tubular ventilation portion can be arranged inside the receptacle in the virtual projection plane perpendicular to the connecting direction of the both housings.

The female housing may be formed with a ventilation hole allowing communication between the sealing space and the tubular ventilation portion. Thus, the ventilation member can be miniaturized by making a length of the tubular ventilation portion shorter.

A one-piece rubber plug may be provided in the female housing and may be formed with sealing holes corresponding to the cavities. The tubular ventilation portion may penetrate through the one-piece rubber plug in an air-tight manner. According to this configuration, the tubular ventilation portion can be held mounted by a resilient force of the one-piece rubber plug.

The ventilation member may be exposed on a back surface of the female housing, and a wire cover for covering the back surface may be mounted on the female housing. Thus, the wire cover ensures that external matter will not interfere with the ventilation member.

DETAILED DESCRIPTION

Figure 1:
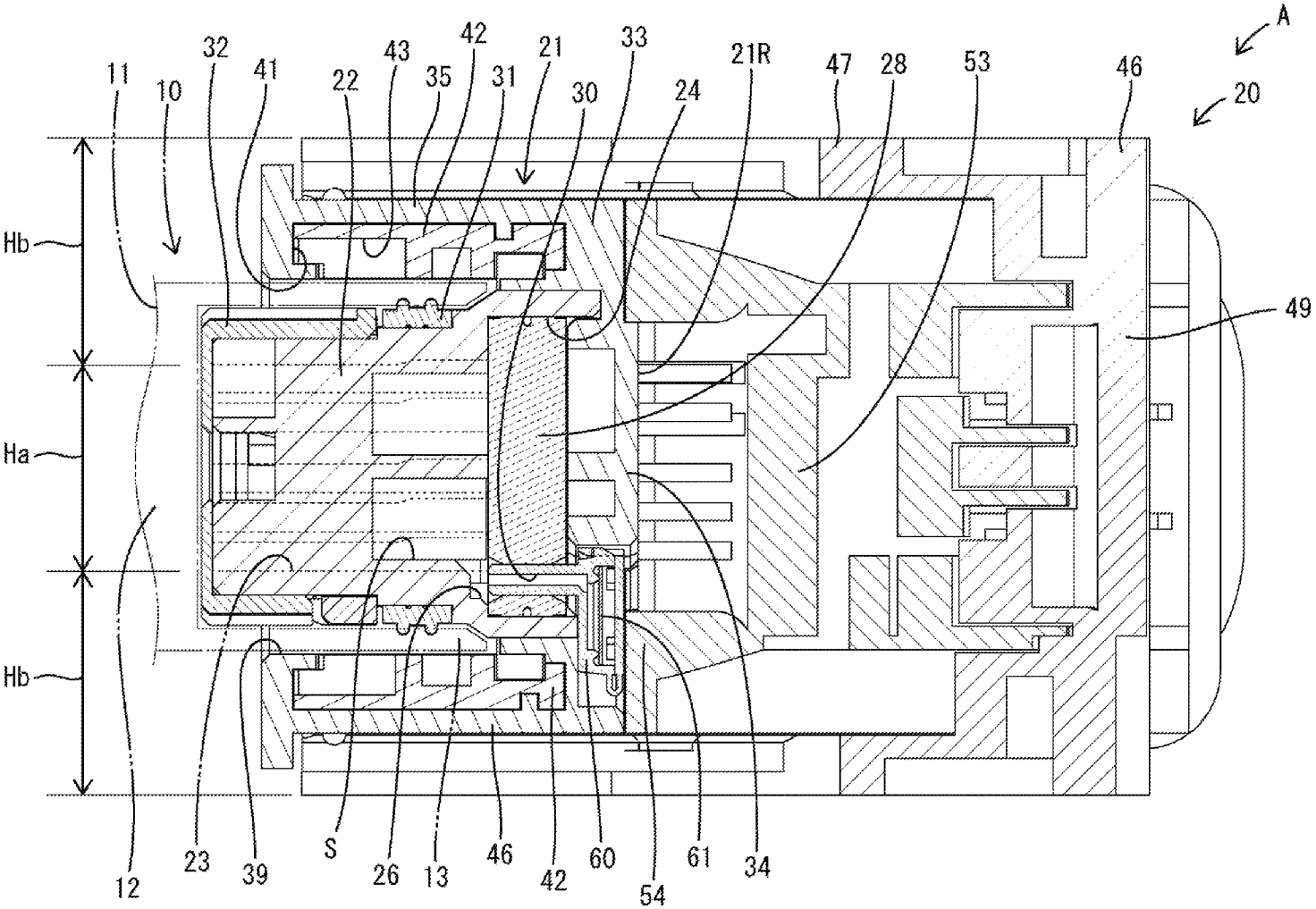
FIG. 1 is a section showing a state where a waterproof connector of a first embodiment is cut along an attached part of a ventilation member.
Figure 2:
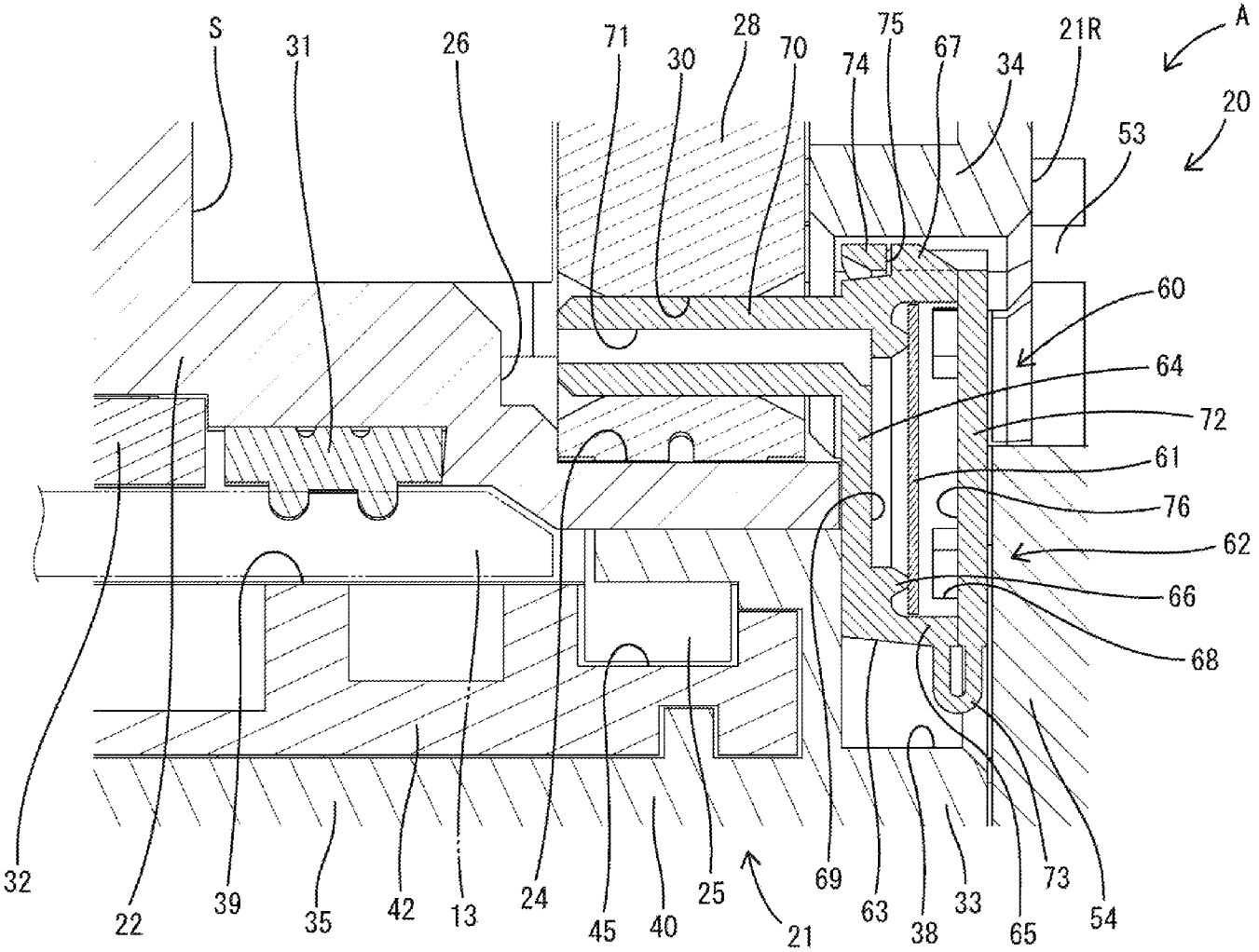
FIG. 2 is a partial enlarged section of FIG. 1.
Figure 3:
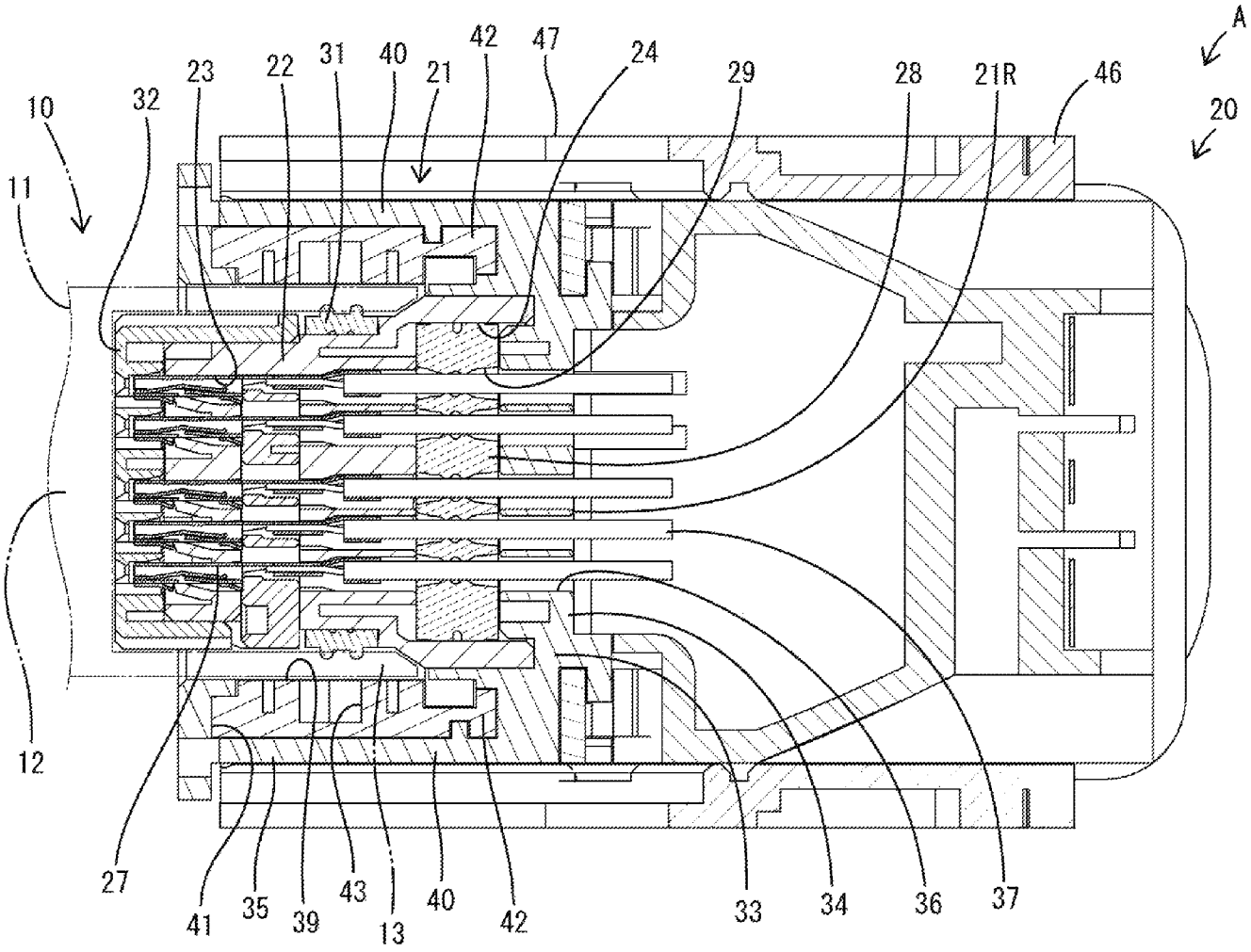
FIG. 3 is a section where wires are inserted through a one-piece rubber plug.

A first embodiment of the invention is described with reference to FIGS. 1 to 6. In the following description, a left side in FIGS. 1 to 3 is the front concerning a front-rear direction. Upper and lower sides in FIGS. 1 to 3 are upper and lower sides concerning a vertical direction.

A waterproof connector A of this embodiment includes a male connector 10 and a female connector 20. The male connector 10 has a male housing 11 made of synthetic resin and male terminal fittings (not shown) are mounted in the male housing 11. A seal ring 31 and a one-piece rubber plug 28 form a sealing space S in a clearance between the connected housings 11 and 21 and inside the female housing 21. The sealing space S is isolated in an air-tight manner from the outside of the waterproof connector A. As shown in FIGS. 1 and 3, the male housing 11 includes a terminal holding portion 12, and a rectangular tubular receptacle 13 extends from the outer periphery of the front surface of the terminal holding portion 12.

<Female Connector 20>

The female connector 20 includes the female housing 21, female terminal fittings 27, the one-piece rubber plug 28, the seal ring 31, a pair of sliders 42, a lever 46, a wire cover 53 and a ventilation member 60.

<Female Housing 21>

The female housing 21 has an inner housing 22 (terminal accommodating portion as claimed), a front member 32 assembled with a front end part of the inner housing 22 and an outer housing 33 all of which are made of synthetic resin.

<Inner Housing 22>

Cavities 23 are formed inside the inner housing 22, and the female terminal fittings 27 are inserted into each cavity 23 from behind. Three sliding pins 25 are formed at intervals in a lateral direction on a rear end part of each of the upper and lower surfaces of the inner housing 22. An accommodating recess 24 is recessed in the rear surface of a rear end part of the inner housing 22, and the rear ends of the cavities 23 are open to the accommodating recess 24.

A virtual projection plane is assumed when the female housing 21 is viewed from the front or behind (i.e. in a direction parallel to a connecting direction of the housings 11, 21). The virtual projection plane is a two-dimensional plane perpendicular to the planes of FIGS. 1 to 3, but is not shown or denoted. As shown in FIG. 1, a smallest and substantially rectangular area that includes all of the cavities 23 in the virtual projection plane is defined as a cavity formation area Ha in the female housing 21. Further, a frame-like area surrounding the cavity formation area Ha of the female housing 21 in the virtual projection plane is defined as an outer peripheral area Hb in the female housing 21. A ventilation hole 26 is formed at a position of the inner housing 22 corresponding to the outer peripheral area Hb in the virtual projection plane and allows the accommodating recess 24 to communicate with the sealing surface S in the inner housing 22.

<One-Piece Rubber Plug 28>

The one-piece rubber plug 28 is accommodated in the accommodating recess 24 so that the outer periphery of the one-piece rubber plug 28 is in close contact with the inner periphery of the accommodating recess 24 in an air-tight manner. Seal holes 29 penetrate the one-piece rubber plug 28 in the front-rear direction and individually correspond to the respective cavities 23. Each seal hole 29 serves as a passage when the female terminal fitting 27 is inserted into the cavity 23. A wire is inserted through each seal hole 29 in an air-tight manner.

Figure 5:
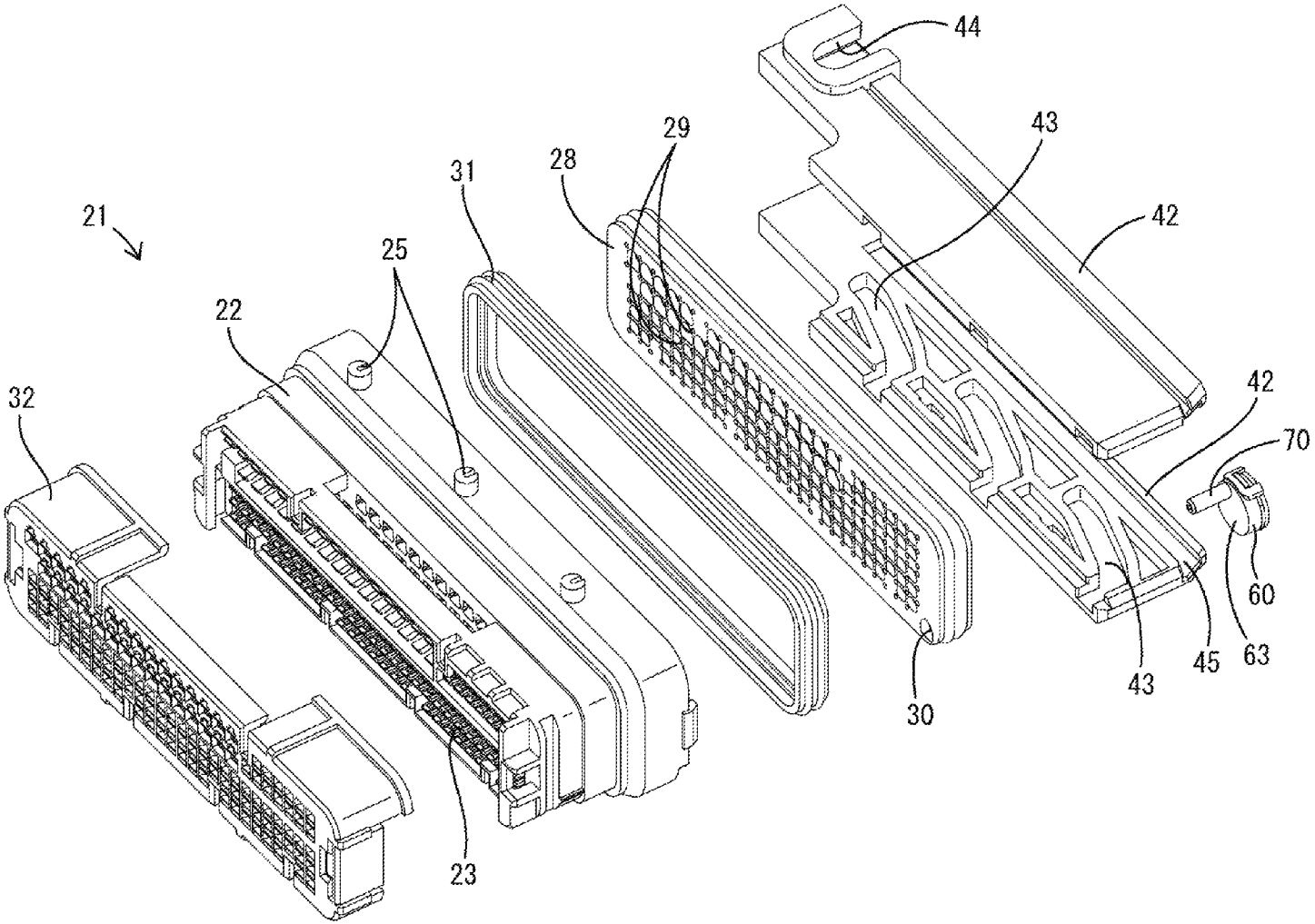
FIG. 5 is an exploded perspective view of some components of a female connector.

In the virtual projection plane, the one-piece rubber plug 28 includes the entire cavity formation area Ha and all of the seal holes 29 are arranged within the range of the cavity formation area Ha. An outer periphery of the one-piece rubber plug 28 is located outside the range of the cavity formation area Ha (i.e. within the range of the outer peripheral area Hb). As shown in FIG. 5, a mounting hole 30 penetrates the one-piece rubber plug 28 in the front-rear direction at a position of corresponding to the outer peripheral area Hb, and a lip (not shown) is formed on the inner periphery of the mounting hole 30. As shown in FIG. 2, the front end of the mounting hole 30 communicates with the rear end of the ventilation hole 26.

<Seal Ring 31>

The seal ring 31 is mounted on the outer periphery of the inner housing 22 and seals between the outer periphery of the inner housing 22 and the inner periphery of the receptacle 13 in an air-tight manner. The seal ring 31 is assembled from the front of the inner housing 22 and held assembled by the front member 32 mounted on a front part of the inner housing 22.

<Outer Housing 33>

The outer housing 33 is assembled with the inner housing 22 from behind. As shown in FIG. 1, the outer housing 33 includes a back wall 34 held in contact with the rear surface of the one-piece rubber plug 28, and a tubular fitting 35 extends forward from the outer periphery of the back wall 34. As shown in FIG. 3, insertion holes 36 penetrate the back wall 34 in the front-rear direction and correspond respectively to the cavities 23 and the seal holes 29. Each insertion hole 36 serves as a passage when the female terminal fitting 27 is inserted into the cavity 23. A wire 37 fixed to a rear part of the female terminal fitting 27 is inserted through each insertion hole 36.

The insertion holes 36 are located within the range of the cavity formation area Ha in the virtual projection plane. As shown in FIG. 2, the rear surface of the back wall 34 is recessed at a position of the back wall 34 corresponding to the outer peripheral area Hb, thereby forming a mounting portion 38. The rear end of the mounting hole 30 of the one-piece rubber plug 28 is open to the mounting portion 38. A holding portion 63 of the ventilation member 60 is accommodated in the mounting portion 38.

The tubular fitting 35 surrounds the entire outer periphery of the inner housing 22. A space between the outer periphery of the inner housing 22 and the inner periphery of the tubular fitting 35 defines a connection space 39 for accommodating the receptacle 13. The receptacle 13 surrounds the inner housing 22 and the tubular fitting 35 surrounds the receptacle 13 when the male connector 10 and the female connector 20 are connected. In the virtual projection plane, the connection space 39 (receptacle 13) and the tubular fitting 35 are located entirely within the range of the outer peripheral area Hb. The tubular fitting 35 includes upper and lower guide walls 40. As shown in FIGS. 1 and 3, a guide groove 41 extends in the lateral direction on a front part of the inner surface of the guide wall 40.

<Sliders 42>

The sliders 42 are plates that are long and narrow in the lateral direction, as shown in FIG. 5, and extend along the inner surfaces of the upper and lower guide walls 40 with a plate thickness direction aligned vertically, as shown in FIGS. 1 to 3. Three cam grooves 43 extend laterally in the inner surface of the slider 42. A driven hole 44 is formed in an outer surface on one lateral end part of the slider 42. A sliding groove 45 is formed in the inner surface of the slider 42. The slider 42 is movable in the lateral direction between the inner surface of the tubular fitting 35 and the outer surface of the inner housing 22 by fitting the sliding groove 45 to the sliding pins 25 and fitting the front part into the guide groove 41.

<Lever 46>

Figure 6:
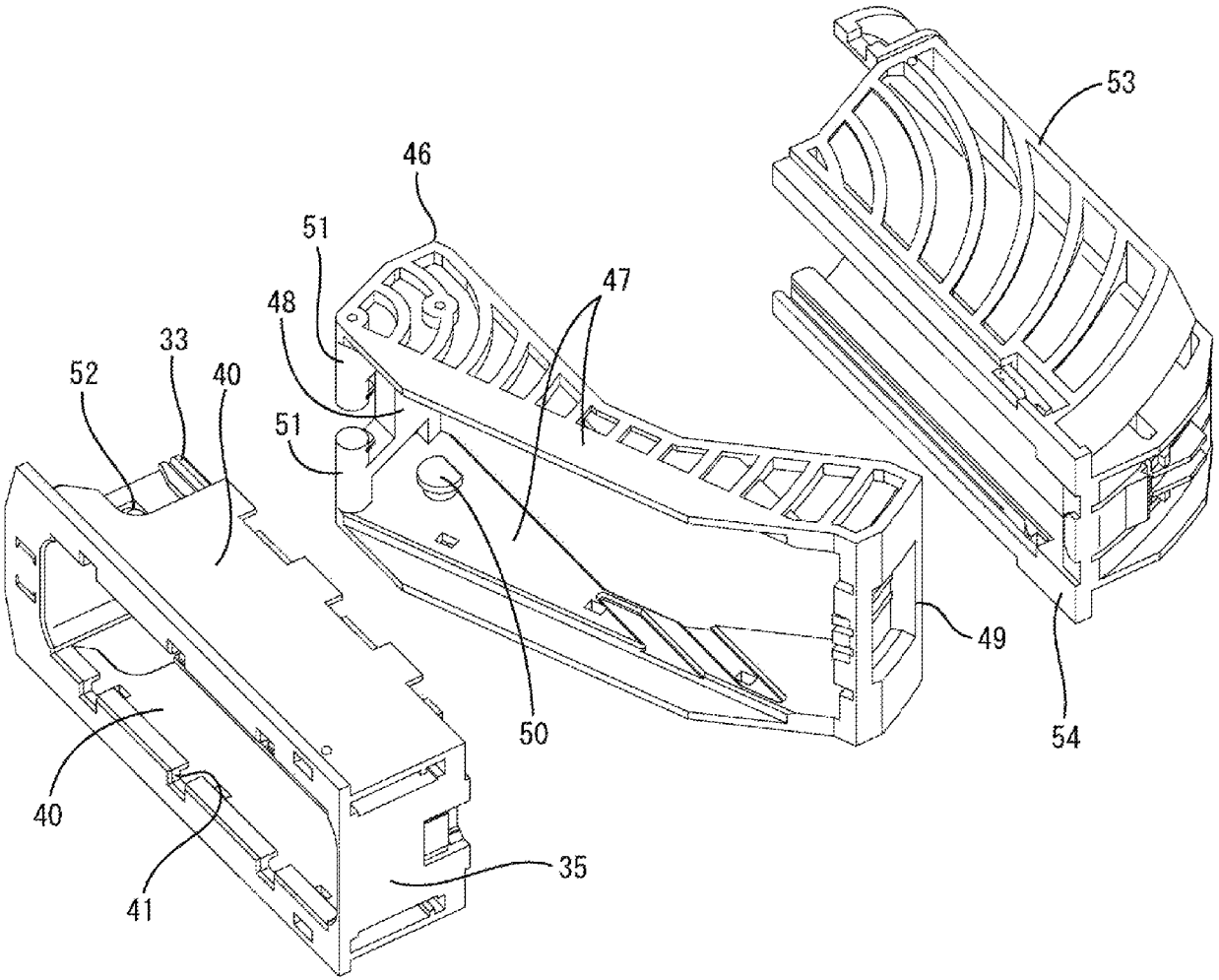
FIG. 6 is an exploded perspective view of other components of the female connector.

As shown in FIG. 6, the lever 46 is a substantially rectangular frame with upper and lower plate-like arms 47 long in the lateral direction, a coupling 48 coupling base ends of the arms 47 and an operating portion 49 coupling leading ends of the arms 47. Two rotary shafts 50 are formed on base end parts of the inner surfaces of the arms 47 and two drive pins 51 are formed at positions of the inner surfaces of the arms 47 slightly closer to leading ends than the base ends. The lever 46 is mounted on the outer housing 33 to be rotatable between an initial position and a connection position by locking the rotary shaft 50 thereof to bearings 52 of the outer housing 33.

The drive pins 51 are fit in the driven holes 44 of the sliders 42 when the lever 46 is mounted. Rotation of the lever 46 from the initial position to the connection position with the drive pins 51 mounted in the driven holes 44 causes the sliders 42 to slide from the initial position to the connection position with a boosting action due to the lever. The sliders 42 slide from the initial position to the connection position with cam followers (not shown) of the male connector 10 fit in the cam grooves 43. Thus, the male connector 10 and the female housing 21 are connected by a boosting action between the cam grooves 43 and the cam followers.

<Wire Cover 53>

As shown in FIG. 3, the wire cover 53 laterally turns wires drawn out from a back surface 21R of the female housing 21. The wire cover 53 is mounted on the outer housing 33 to cover the entire area (wire draw-out surface in the female housing 21) of the back wall 34. The front surface of the wire cover 53 contacts the back surface of the outer housing 33 (rear surface of the back wall 34). As shown in FIG. 1, the front surface of the wire cover 53 includes a closing portion 54 for closing a part of an opening area of the mounting portion 38 in the rear surface of the back wall 34.

<Ventilation Member 60>

Figure 4:
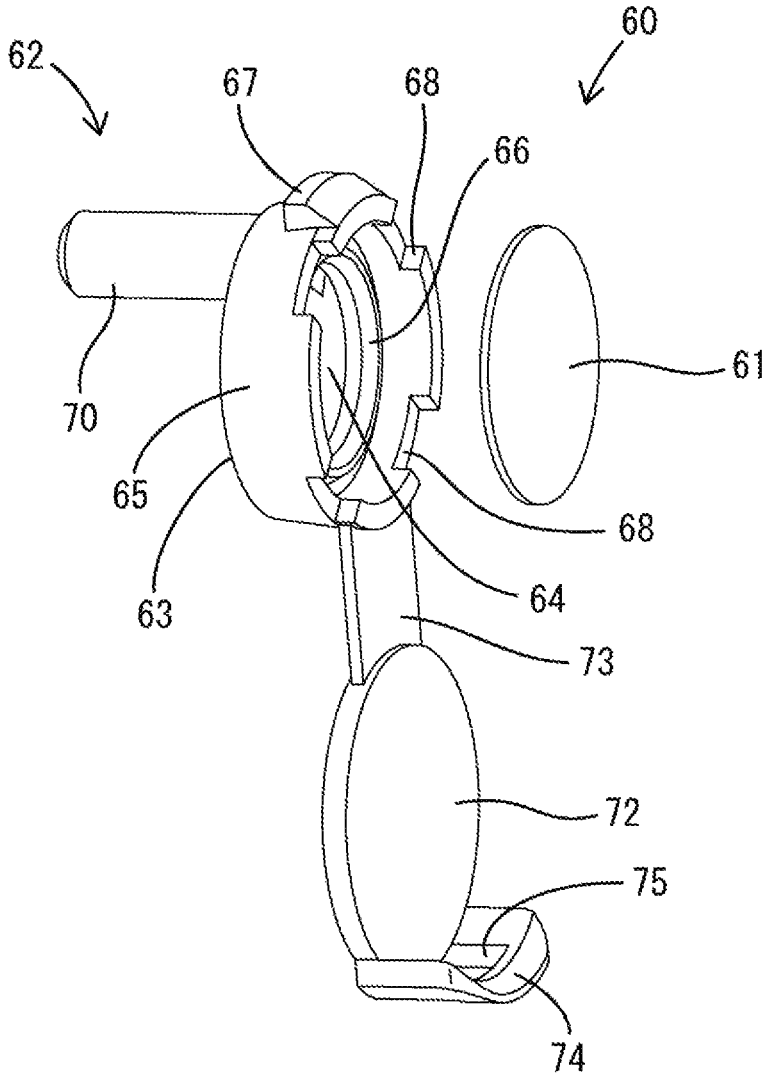
FIG. 4 is an exploded perspective view of the ventilation member.

As shown in FIG. 4, the ventilation member 60 includes a disc-like ventilation film 61 and a holder 62 to be mounted into the female housing 20 while holding the ventilation film 61. The ventilation film 61 is formed of a material that allows the passage of air, but does not allow the passage of liquid. A porous PTFE (polytetrafluoroethylene) film is used as a specific example. A diameter of the ventilation film 61 is larger than a thickness of a wall of the receptacle 13.

The holder 62 is a single component made of synthetic resin and includes the holding portion 63, a tubular ventilation portion 70 and a lid 72. The holding portion 63 includes a substantially circular supporting wall 64 whose wall thickness direction is aligned with the front-rear direction, and an annular portion 65 in the form of a circular ring projecting rearward from the outer peripheral edge of the supporting wall 64. A projection-like support 66 projects concentrically on the rear surface of the supporting wall 64 (inner surface of the holding portion 63). A locking projection 67 is formed on the outer peripheral surface of the annular portion 65, and circumferentially spaced cuts 68 are formed on a rear end of the annular portion 65.

As shown in FIG. 2, the ventilation film 61 is accommodated in the holding portion 63. An outer peripheral part of the ventilation film 61 is fit to the inner periphery of the annular portion 65. The front surface of the ventilation film 61 contacts the projection-like support 66 in an air-tight manner. A space enclosed by the supporting wall 64, the projection-like support 66 and the ventilation film 61 in an internal space of the holding portion 63 defines a ventilation space 69.

The tubular ventilation portion 70 is a pipe whose axis line is aligned with the front-rear direction (parallel to a film thickness direction of the ventilation film 61), and is cantilevered straight forward from the front surface of the supporting wall 64. An outer diameter of the tubular ventilation portion 70 is smaller than that of the ventilation film 61, and the tubular ventilation portion 70 is at a position eccentric from a center of the supporting wall 64 toward an outer peripheral side. The interior of the tubular ventilation portion 70 defines a ventilation path 71. The front end of the ventilation path 71 is open to the outside in the front end surface of the tubular ventilation portion 70 and the rear end thereof communicates with the ventilation space 69.

The lid 72 is disc-like and connected to the outer peripheral surface of the annular portion 65 via a hinge 73. The hinge 73 is at a position opposite to the locking projection 67 with respect to a center of the holding portion 63. A locking claw 74 projects forward from a position of the outer periphery of the lid 72 opposite to the hinge 73 with respect to a center of the lid 72. The locking claw 74 is formed with a locking hole 75.

The lid 72 is mounted substantially concentrically on the holding portion 63 with the hinge 73 deformed and folded. The lid 72 is held mounted on the holding portion 63 by locking the locking hole 75 to the locking projection 67. The mounted lid 72 closes an opening in the rear surface of the holding portion 63 by contacting the rear end edge of the annular portion 65. The closed lid 72 prevents external matter from interfering with the ventilation film 61.

A communication space 76 is enclosed by the annular portion 65, the ventilation film 61 and the lid 72. The ventilation film 61 partitions the communication space 76 from the ventilation space 69 in a liquid-tight manner. Further, the communication space 76 communicates with the outside of the holder 63 (ventilation member 60) via the cut portions 68.

<Functions of First Embodiment>

The ventilation member 60 is mounted into the female housing 21 and the one-piece rubber piece 28 from behind the outer housing 33. The ventilation member 60 is mounted by inserting the tubular ventilation portion 70 into the mounting portion 38 to be fit into the mounting hole 30 of the one-piece rubber piece 28, and the holding portion 63 is accommodated into the mounting portion 38. A clearance between the inner periphery of the mounting hole 30 and the outer periphery of the tubular ventilation portion 70 is sealed in an air-tight manner by the lip on the inner periphery of the mounting hole 30. Further, the front end of the tubular ventilation portion 70 (ventilation path 71) communicates with the ventilation hole 26.

The sealing space S formed by connecting the connectors 10, 20 communicates with the ventilation hole 26, the ventilation path 71 (tubular ventilation portion 70) and the ventilation space 69. When a pressure in the sealing space S becomes higher than in an outside space of the waterproof connector A, air in the sealing space S flows out to the communication space 76 and the outside space through the ventilation film 61, thereby suppressing a pressure increase in the sealing space S. When the pressure in the sealing space S becomes lower than in the outside space of the waterproof connector A, air in the outside space flows into the sealing space S through the ventilation film 61 to suppress a pressure reduction in the sealing space S. These functions keep the pressure inside the waterproof connector A constant.

The waterproof connector A of this first embodiment includes the female housing 21 configured to form the sealing space S by being connected to the male housing 11. The female housing 21 includes the inner housing 22 and the tubular fitting 35. The inner housing 22 includes the cavities 23 into which the female terminal fittings 27 are to be inserted, and is fit into the receptacle 13 of the male housing 11. The tubular fitting 35 surrounds the inner housing 22 and fits to the outer periphery of the receptacle 13.

The waterproof connector A further includes the ventilation member 60. The ventilation member 60 includes the ventilation film 61 enabling ventilation between the sealing space S and the outside of the female housing 21. The ventilation member 60 is mounted into the female housing 21 via the one-piece rubber piece 28 and the entire ventilation film 61 is located in the outer peripheral area Hb in the virtual projection plane perpendicular to the connecting direction of the both housings 11, 21. In the virtual projection plane, a part of the ventilation film 61 overlaps the receptacle 13 (connection space 39). Note that although the part of the ventilation film 61 overlaps the receptacle 13 in the vertical direction in FIG. 1, the part of the ventilation film 61 overlaps the receptacle 13 also in the lateral direction (direction perpendicular to the plane of FIG. 1).

Note that although a part (upper end part) of the ventilation member 60 is drawn to be included within the range of the cavity formation area Ha in FIG. 1, the mounting hole 30 into which the tubular ventilation portion 70 of the ventilation member 60 is to be fit is arranged at a position deviated from the formation range of the seal holes 29 (i.e. cavity formation area Ha) in the lateral direction (direction perpendicular to the plane of FIG. 1) as shown in FIG. 5. Thus, the ventilation member 60 is arranged entirely within the cavity formation area Ha.

According to this configuration, even if there is no empty cavity 23 into which the female terminal fitting 27 is not to be inserted, the ventilation member 60 can be mounted into the female housing 21. Further, the ventilation member 60 is arranged such that the ventilation film 61 at least partially overlaps the receptacle 13 in the connecting direction of the housings 11, 21. Thus, a dedicated space necessary only to arrange the ventilation member 60 in the virtual projection plane perpendicular to the connecting direction of the housings 11, 21 is small. In this way, the enlargement of the female housing 21 can be avoided.

The ventilation member 60 includes the holding portion 63 and the tubular ventilation portion 70. The holding portion 63 holds the ventilation film 61 in a state oriented in a direction intersecting the connecting direction of the housings 11, 21. The tubular ventilation portion 70 extends from the holding portion 63 and communicates with the sealing space S. A cross-sectional area of the tubular ventilation portion 70 intersecting with an extending direction thereof is smaller than an outer diameter of the ventilation film 61. According to this configuration, even if the ventilation film 61 is at a position distant from the sealing space S, air can flow between the interior of the sealing space S and the outside of the female housing 21 through the tubular ventilation portion 70. Further, since the cross-sectional area of the tubular ventilation portion 70 is smaller than the ventilation film 61, the tubular ventilation portion 70 can be arranged in a narrow part.

The tubular ventilation portion 70 extends substantially parallel to the connecting direction of the housings 11, 21 and is eccentric from the center of the ventilation film 61. Thus, the tubular ventilation portion 70 can be arranged inside the receptacle 13 in the virtual projection plane. Further, the female housing 21 is formed with the ventilation hole 26 that allows communication between the sealing space S and the tubular ventilation portion 70. Thus, the ventilation member 60 can be miniaturized by making a length of the tubular ventilation portion 70 shorter.

The female housing 21 has the one-piece rubber piece 28 formed with the penetrating seal holes 29 corresponding to the cavities 23, and the tubular ventilation portion 70 penetrates through the one-piece rubber piece 28 in an air-tight manner. According to this configuration, the tubular ventilation portion 70 can be held mounted by a resilient force of the one-piece rubber piece 28 with the lip on the inner periphery of the mounting hole 30.

The ventilation member 60 is accommodated in the mounting portion 38 formed in the back surface of the back wall 34 of the outer housing 33 and therefore is exposed on the back surface 21R of the female housing 21. However, the wire cover 53 is mounted on the female housing 21 to cover the back surface 21 and to prevent external matter from interfering with the ventilation member 60. Further, the closing portion 54 of the wire cover 53 presses the outer surface of the lid 72 and prevents the ventilation member 60 from being displaced rearwardly or detached from the mounting portion 38.

Second Embodiment

Figure 7:
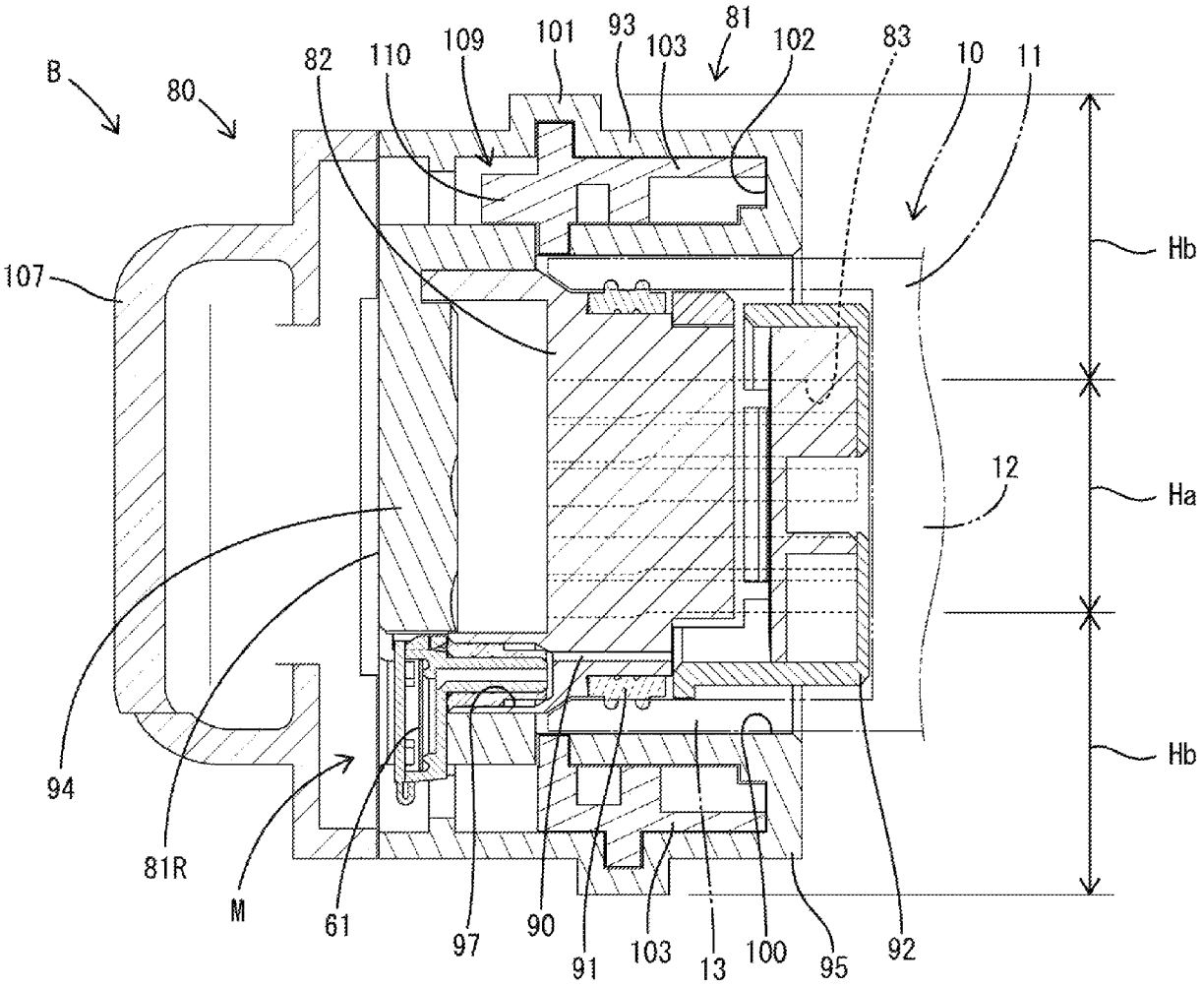
FIG. 7 is a section showing a waterproof connector of a second embodiment cut along an attached part of a ventilation member.
Figure 8:
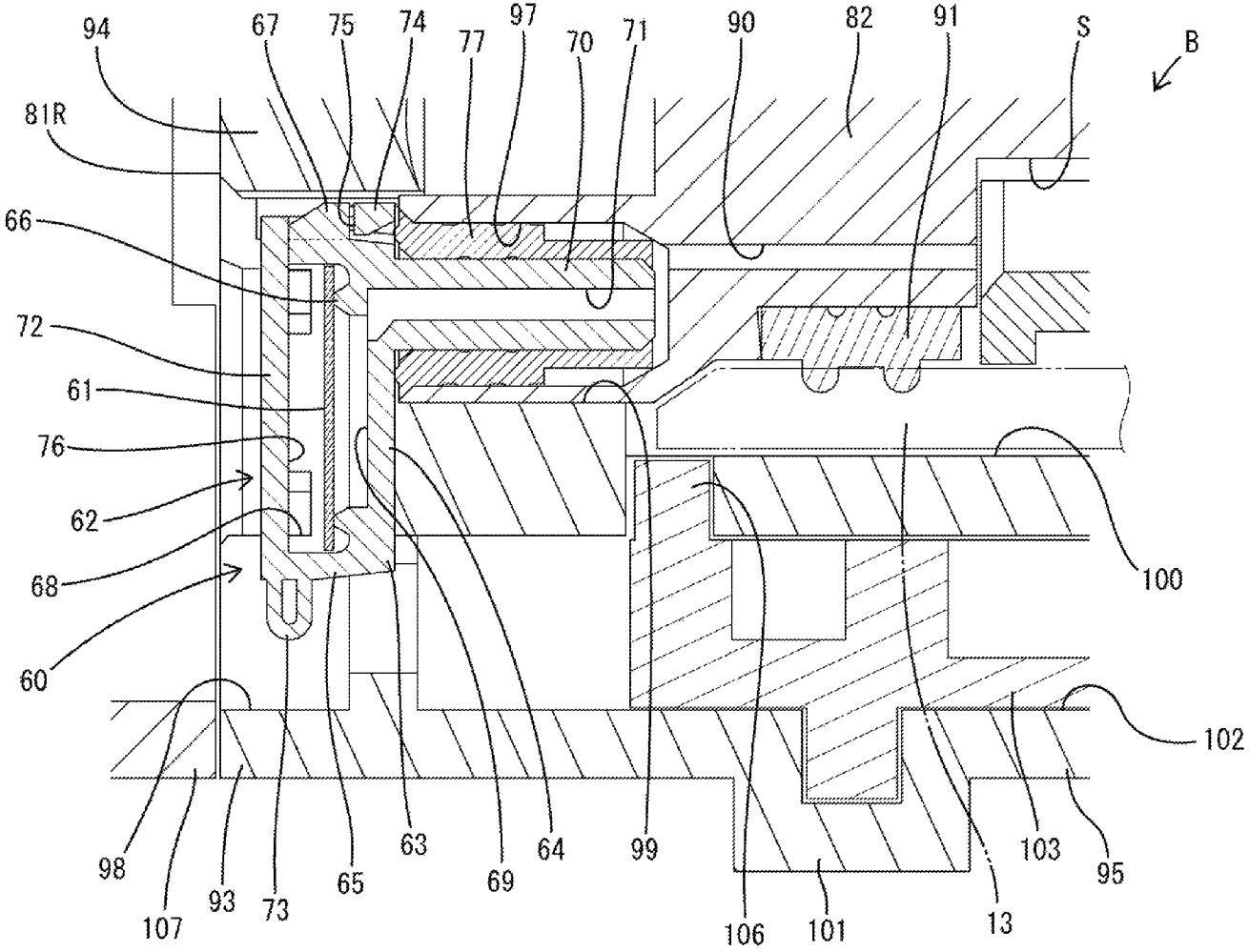
FIG. 8 is a partial enlarged section of FIG. 7.
Figure 9:
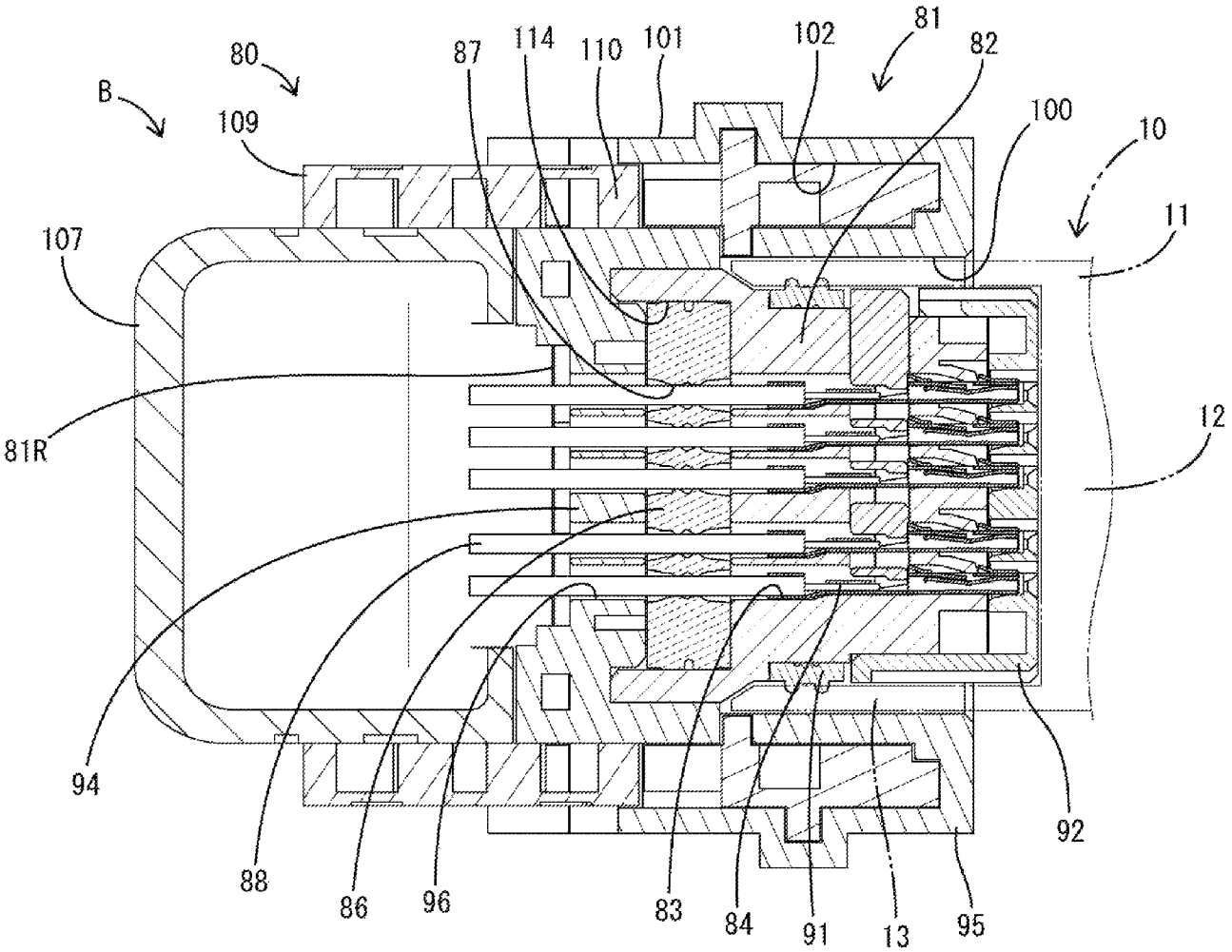
FIG. 9 is a section showing a mounted state of terminal fittings.

A second embodiment of the invention is described with reference to FIGS. 7 to 12. Note that, in the following description, a right side in FIGS. 7 to 9 is defined as a front side concerning a front-rear direction. Upper and lower sides shown in FIGS. 7 to 9 are defined as upper and lower sides concerning a vertical direction.

A waterproof connector B of this second embodiment has a male connector 10 with a male housing 11 and a female connector 80 with a female housing 81. The male connector 10 has the same structure as the first embodiment. A seal ring 91, a one-piece rubber piece 86 and individual rubber plugs (not shown) form a sealing space S in a clearance between the housings 11 and 81 and inside the female housing 81 when the male and female housings 11 and 81 are connected. The sealing space S is isolated in an air-tight manner from outside of waterproof connector B.

<Female Connector 80>

The female connector 80 includes the female housing 81, first female terminal fittings 84, second female terminal fittings (not shown), the one-piece rubber plug 86, the seal ring 91, a pair of sliders 103, a wire cover 107, a lever 109 and a ventilation module M.

<Female Housing 81>

The female housing 81 is configured by assembling an inner housing 82 (terminal accommodating portion as claimed), a font member 92 and an outer housing 93, all of which are made of synthetic resin. The front member 92 is assembled with a front end part of the inner housing 82.

<Inner Housing 82>

Figure 11:
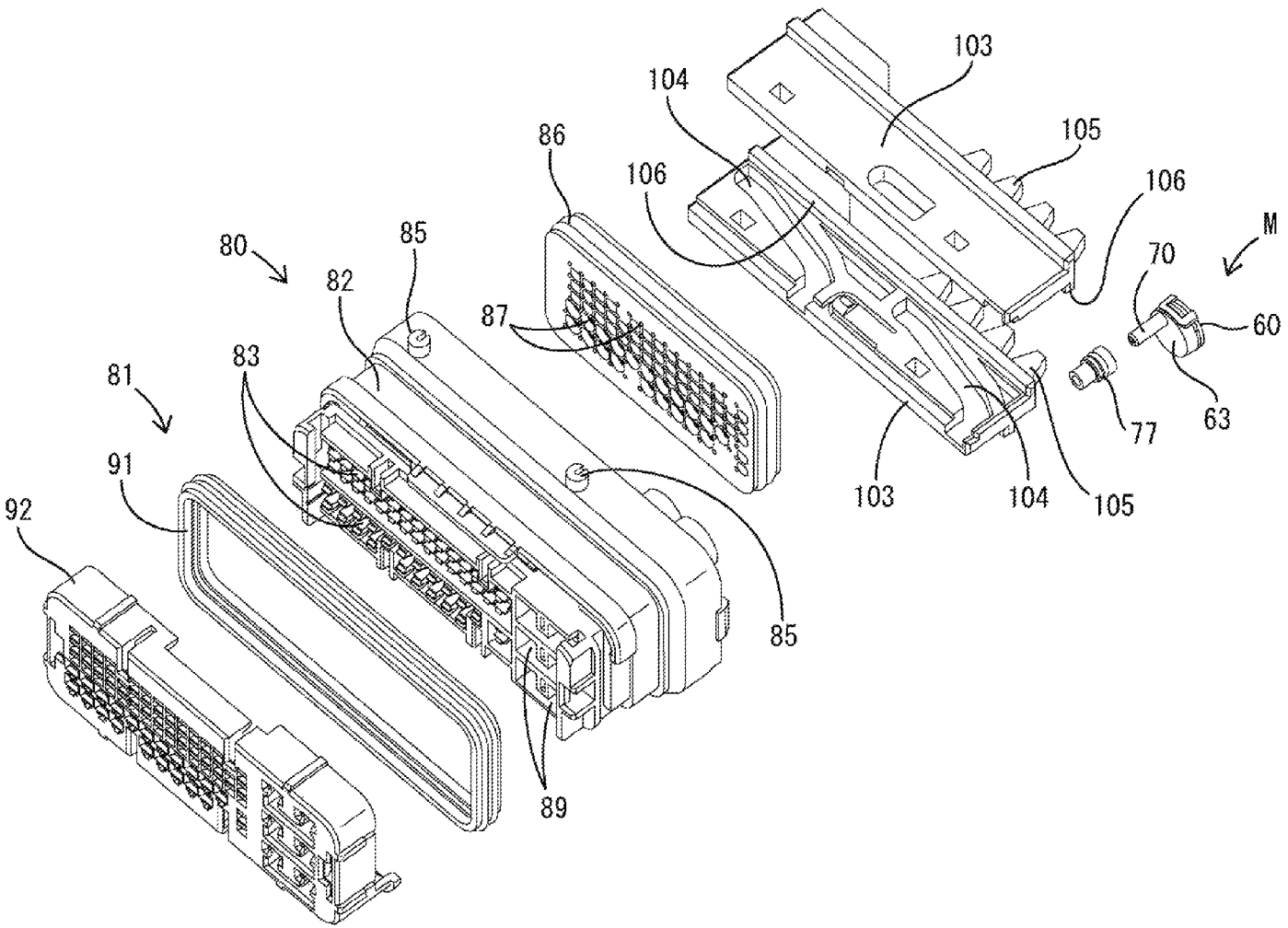
FIG. 11 is an exploded perspective view of some components of a female connector.
Figure 12:
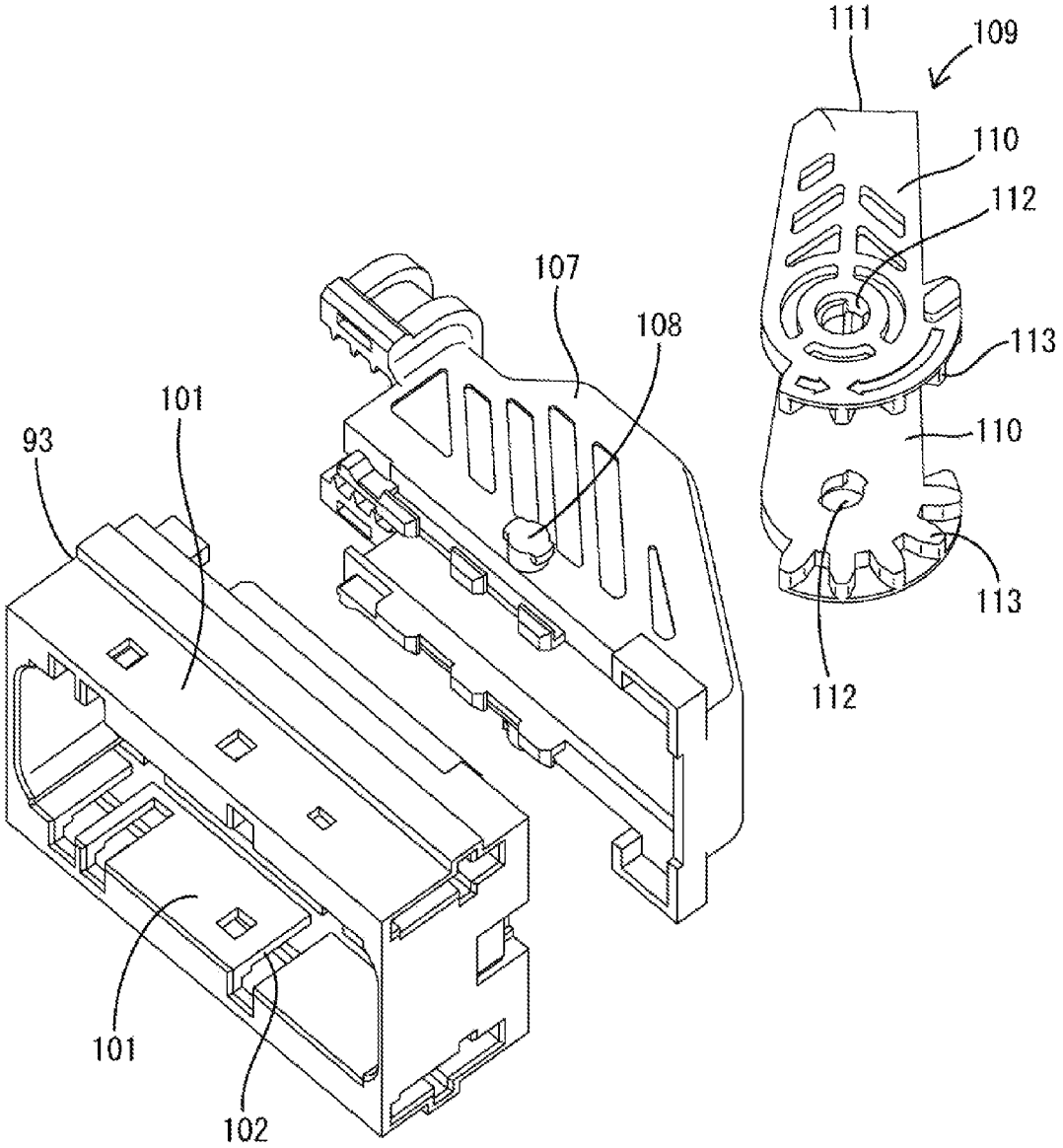
FIG. 12 is an exploded perspective view of other components of the female connector.

As shown in FIG. 11, first cavities 83 and second cavities 89 are formed inside the inner housing 82. A first female terminal fitting 87 is inserted into each first cavity 83 from behind. Two sliding pins 85 are formed at an interval in a lateral direction on a rear end part of each of the upper and lower surfaces of the inner housing 82. An accommodating recess 114 is formed by recessing a formation range of the first cavities 83 out of the rear surface of a rear end part of the inner housing 82. Rear ends of the first cavities 83 are open to the accommodating recess 114.

The one-piece rubber plug 86 is accommodated in the accommodating recess 114, and the outer periphery of the one-piece rubber plug 86 closely contacts the inner periphery of the accommodating recess 114 in an air-tight manner. Seal holes 87 penetrate the one-piece rubber plug 86 in the front-rear direction at positions corresponding to the first cavities 83. Each seal hole 87 defines a passage path when the first female terminal fitting 84 is inserted into the first cavity 83. Wires 88 crimped to the rear ends of the first female terminal fittings 84 and the second female terminal fittings are inserted through the respective seal holes 87 in an air-tight manner.

The second cavities 89 are arranged in one lateral end part of the inner housing 82, and second female terminal fittings (not shown) are inserted into each second cavity 89. The second cavities 89 are not open to the accommodating recess 114. An individual rubber plug (not shown) is fit externally on a rear end part of the second female terminal fitting and fixed together with the wire (not shown). The individual rubber plug seals a clearance between the second terminal fitting and the inner periphery of the second cavity 89 in an air-tight manner when the second female terminal fitting is inserted in the second cavity 89.

If a virtual projection plane (not shown) when the female housing 81 is viewed from the front or behind is assumed, a smallest and substantially rectangular area including a formation range of all of the first cavities 83 and a formation area of all of the second cavities 89 in that virtual projection plane is defined as a cavity formation area Ha in the female housing 81. Further, a frame-like area surrounding the cavity formation area Ha of the female housing 81 in the virtual projection plane is defined as an outer peripheral area Hb in the female housing 81. A ventilation hole 90 is formed at a position of the inner housing 82 corresponding to the outer peripheral area Hb and inside a connection space 100 in the virtual projection plane to allow a mounting portion 97 to communicate with the sealing surface S in the inner housing 22.

<Seal Ring 91>

The seal ring 91 is mounted on the outer periphery of the inner housing 82 for sealing between the outer periphery of the inner housing 82 and the inner periphery of a receptacle 13 in an air-tight manner. The seal ring 91 is assembled from the front of the inner housing 82 and is held assembled by the front member 92 mounted on a front end part of the inner housing 82.

<Outer Housing 93>

The outer housing 93 is assembled with the inner housing 82 from behind. The outer housing 93 includes a back wall 94 that is held in contact with the rear surface of the one-piece rubber plug 86 and a tubular fitting 95 that extends forward from the outer periphery of the back wall 94. First insertion holes 96 penetrate the back wall 94 in the front-rear direction at positions corresponding to the first cavities 83 and the seal holes 87. Each first insertion hole 96 defines a passage path when the first female terminal fitting 84 is inserted into the first cavity 83. The wire is inserted through each first insertion hole 96.

Similarly, second insertion holes (not shown) penetrate the back wall 94 in the front-rear direction at positions corresponding to the second cavities 89. Each second insertion hole defines a passage path when the second female terminal fitting (not shown) is inserted into the second cavity 89. The wire (not shown) is inserted through each second insertion hole. The first insertion holes 96 and the second insertion holes are located within the range of the cavity formation area Ha in the virtual projection plane.

The mounting portion 97 is formed by recessing rear end parts of the inner housing 82 and the outer housing 93 at positions of the female housing 81 corresponding to the outer peripheral area Hb. As shown in FIG. 8, the mounting portion 97 has a circular first accommodating portion 98 open on the rear surface of the back wall 94 (back surface 81R of the female housing 81) and a second accommodating portion 99 having a circular cross-section and formed by recessing the rear surface of the inner housing 82. The rear end of the second accommodating portion 99 is open in the back end surface of the first accommodating portion 98. The front end of the second accommodating portion 99 communicates with the rear end of the ventilation hole 90.

The tubular fitting 95 surrounds the entire outer periphery of the inner housing 82. A space between the outer periphery of the inner housing 82 and the inner periphery of the tubular fitting 95 defines the connection space 100 for accommodating the receptacle 13. The receptacle 13 surrounds the inner housing 82 and the tubular fitting 95 surrounds the receptacle 13 when the male and female connectors 10 and 80 are connected. In the virtual projection plane, the connection space 100 (receptacle 13) and the tubular fitting 95 are located entirely within the range of the outer peripheral area Hb. The tubular fitting 95 includes upper and lower guide walls 101 and a guide groove 102 extends in the lateral direction along the inner surface of the guide wall 101.

<Sliders 103>

As shown in FIGS. 9 and 11, the sliders 103 are in the form of plates long and narrow in the lateral direction and extend along the inner surfaces of the upper and lower guide walls 101 to fit in the guide grooves 102 with a plate thickness direction aligned vertically. Two cam grooves 104 extend laterally along the inner surface of the slider 42. A rack 105 is formed on a rear end edge of one lateral end part of the slider 103, and a sliding rib 106 is formed along a rear end edge of the inner surface of the slider 103. The slider 103 is movable laterally between the inner surface of the tubular fitting 95 and the outer surface of the inner housing 82 by being fit in the guide groove 102 and sliding the sliding rib 106 in contact with the sliding pins 85.

<Wire Cover 107>

The wire cover 107 laterally turns wires drawn out from the back surface 81R of the female housing 81. The wire cover 107 is mounted on the outer housing 93 to cover the entire wire draw-out surface of the back wall 94 of the female housing 81. That is, the wire cover 107 covers an opening area of the mounting portion 97 that opens in the rear surface of the female housing 81. Support shafts 108 are formed on upper and lower outer surfaces of the wire cover 107.

<Lever 109>

The lever 109 includes upper and lower plate-like arms 110 long in the lateral direction and an operating portion 111 coupling leading end parts of the arms 110. Bearing holes 112 and pinions 113 are formed on base end parts of the inner surfaces of the arms 110 and are arranged to concentrically surround the bearing holes 112. The lever 109 is mounted on the wire cover 107 to be rotatable between an initial position and a connection position by fitting the bearing holes 112 thereof to the support shafts 108 of the wire cover 107.

The pinions 113 of the mounted lever 109 are fit to the racks 105 of the sliders 103. When the lever 109 is rotated from the initial position to the connection position by fitting the pinions 113 and the racks 105, the sliders 103 slide from the initial position to the connection position by a boosting action by the principle of lever. When the sliders 103 slide from the initial position to the connection position with cam followers (not shown) of the male connector 10 fit in the cam grooves 104, the male connector 10 and the female housing 81 are connected by a boosting action by the cam grooves 104 and the cam followers.

<Ventilation Module M>

Figure 10:
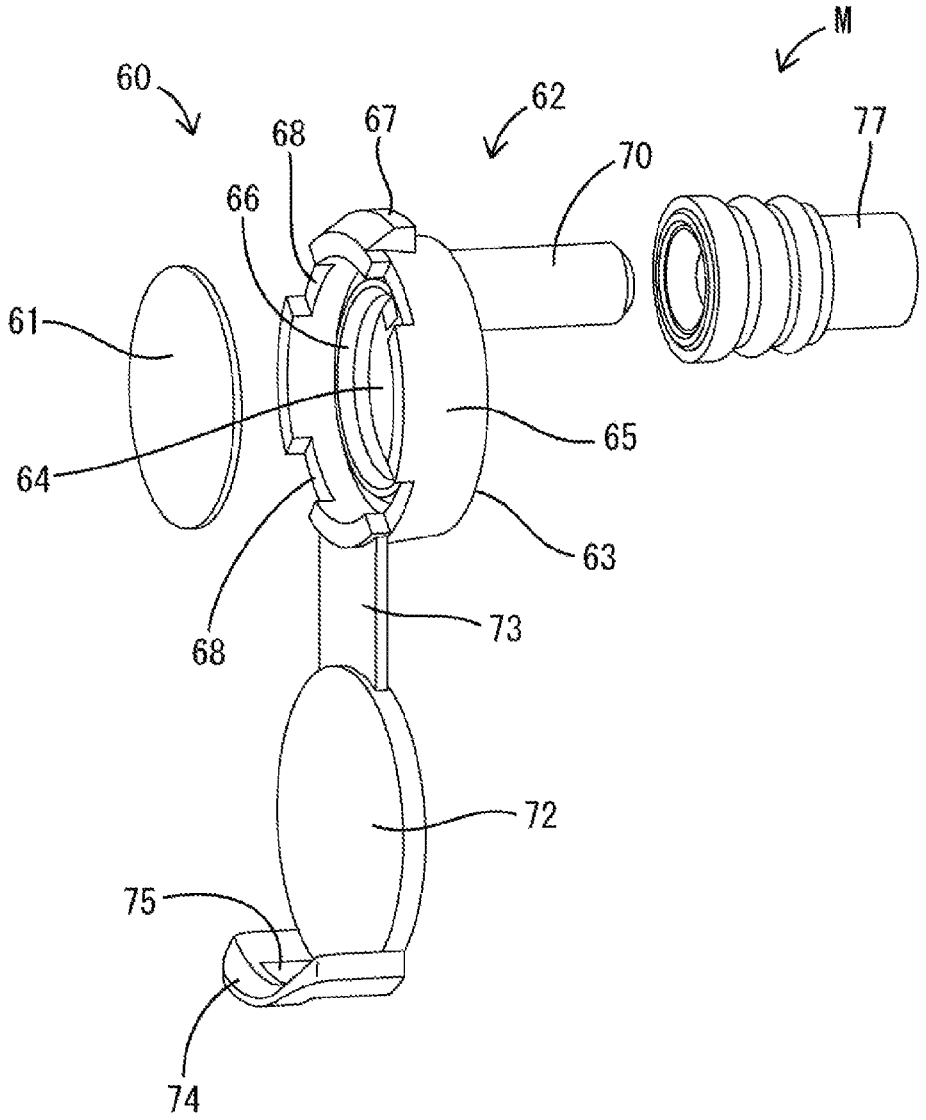
FIG. 10 is an exploded perspective view of the ventilation member.

As shown in FIG. 10, the ventilation module M is configured by assembling a ventilation member 60 structured as in the first embodiment and a cylindrical waterproof plug 77 made of rubber. Components of the ventilation member 60 are denoted by the same reference signs as in the first embodiment and not described in detail.

An inner diameter of the waterproof plug 77 in a state not mounted on the ventilation member 60 is smaller than an outer diameter of a tubular ventilation portion 70. An outer diameter of the waterproof plug 77 in a state not mounted in the female housing 81 is larger than an inner diameter of the second accommodating portion 99. The waterproof plug 77 is fit externally on the tubular ventilation portion 70 of the ventilation member 60.

<Functions of Second Embodiment>

The ventilation module M is mounted into the female housing 81 from behind the outer housing 93 by inserting the waterproof plug 77 and the tubular ventilation portion 70 into the second accommodating portion 99 and accommodating a holding portion 63 into the first accommodating portion 98. The waterproof plug 77A deforms resiliently to seal a space between the inner periphery of the second accommodating portion 99 and the outer periphery of the tubular ventilation portion 70 in an air-tight manner. The front end of the tubular ventilation portion 70 (ventilation path 71) communicates with the ventilation hole 90.

The sealing space S formed by connecting the connectors 10, 80 communicates with the ventilation hole 90, the ventilation path 71 (tubular ventilation portion 70) and a ventilation space 69. When a pressure in the sealing space S becomes higher than pressure in a space outside of the waterproof connector B, air in the sealing space S flows out to the communication space 76 and the outside space through a ventilation film 61, thereby suppressing a pressure increase in the sealing space S. When the pressure in the sealing space S becomes lower than in the outside space of the waterproof connector B, air in the outside space flows into the sealing space S through the ventilation film 61 to suppress a pressure reduction in the sealing space S.

The waterproof connector B of this second embodiment includes the female housing 81 is configured to form the sealing space S when connected to the male housing 11. The female housing 81 includes the inner housing 82 (terminal accommodating portion) and the tubular fitting portion 95. The inner housing 82 includes the first cavities 83 that receive the first female terminal fittings 84 and the second cavities 89 that receive the second female terminal fittings (not shown). The inner housing 82 is inserted into the receptacle 13 of the male housing 11 so that the tubular fitting 95 surrounds the inner housing 82 and fits to the outer periphery of the receptacle 13.

The waterproof connector B further includes the ventilation member 60. The ventilation member 60 includes the ventilation film 61 enabling ventilation between the sealing space S and the outside of the female housing 81. The ventilation member 60 is mounted into the female housing 81 and the entire ventilation film 61 is located in the outer peripheral area Hb in the virtual projection plane perpendicular to a connecting direction of the housings 11, 81. In the virtual projection plane, a part of the ventilation film 61 overlaps the receptacle 13 (connection space 100).

According to this configuration, the ventilation member 60 can be mounted into the female housing 81 even if there is no empty cavity. Further, the ventilation member 60 is arranged so that the ventilation film 61 at least partially overlaps the receptacle 13 in the connecting direction of the housings 11, 81. Thus, a dedicated space necessary only to arrange the ventilation member 60 in the virtual projection plane perpendicular to the connecting direction of the housings 11, 81 is small. In this way, the enlargement of the female housing 81 can be avoided.

The ventilation member 60 includes the holding portion 63 and the tubular ventilation portion 70. The holding portion 63 holds the ventilation film 61 in a state oriented in a direction intersecting the connecting direction of the housings 11, 81. The tubular ventilation portion 70 extends from the holding portion 63 and communicates with the sealing space S. A cross-sectional area of the tubular ventilation portion 70 intersecting with an extending direction thereof is smaller than an outer diameter of the ventilation film 61. Accordingly, even if the ventilation film 61 is at a position distant from the sealing space S, ventilation is possible between the interior of the sealing space S and the outside of the female housing 81 through the tubular ventilation portion 70. Further, the cross-sectional area of the tubular ventilation portion 70 is smaller than the ventilation film 61, so that the tubular ventilation portion 70 can be arranged in a narrow part.

The tubular ventilation portion 70 extends substantially parallel to the connecting direction of the housings 11, 81 and is eccentric from a center of the ventilation film 61. Thus, the tubular ventilation portion 70 can be arranged inside the receptacle 13 in the virtual projection plane. Further, the ventilation hole 90 of the female housing 81 allows communication between the sealing space S and the tubular ventilation portion 70. Thus, the ventilation member 60 can be miniaturized by making a length of the tubular ventilation portion 70 shorter.

Further, the ventilation member 60 is accommodated in the mounting portion 97 open in the back surface of the back wall 94 of the outer housing 93 and is exposed on the back surface 81R of the female housing 81. However, the wire cover 107 is mounted on a back of the female housing 81 to cover the back surface 81R. Thus, the wire cover 107 prevents external matter from interfering with the ventilation member 60.

The invention is not limited to the above described and illustrated embodiments. For example, the following embodiments also are included in the scope of the invention.

Although the tubular ventilation portion is arranged at the position eccentric from the center of the ventilation film in the above first and second embodiments, the tubular ventilation portion may be arranged in a central part of the ventilation film.

Although the tubular ventilation portion extends substantially in parallel to the connecting direction in the above first and second embodiments, the tubular ventilation portion may extend in a direction intersecting with the connecting direction.

Although the cross-sectional area of the tubular ventilation portion is smaller than the ventilation film in the above first and second embodiments, the cross-sectional area of the tubular ventilation portion may be equal to or larger than the ventilation film.

Although the ventilation member includes the tubular ventilation portion extending from the holding portion in the above first and second embodiments, the ventilation member may not include the tubular ventilation portion.

Although the female housing is formed with the ventilation hole allowing communication between the sealing space and the tubular ventilation portion in the above first and second embodiments, the female housing may not be formed with the ventilation hole and the tubular ventilation portion may be directly located in the sealing space.

Although the wire cover is provided to cover the back surface of the female housing in the above first and second embodiments, the wire cover may not be mounted on the female housing.

Although the ventilation film only partially overlaps the receptacle in the virtual projection plane since the diameter of the ventilation film is larger than the thickness of the receptacle in the above first and second embodiments, the entire ventilation film may overlap the receptacle in the virtual projection plane if the diameter of the ventilation film is equal to or smaller than the thickness of the receptacle.

LIST OF REFERENCE SIGNS

A, B . . . waterproof connector
S . . . sealing space
11 . . . male housing
13 . . . receptacle
21, 80 . . . female housing
21R, 81R . . . back surface of female housing
22, 82 . . . inner housing (terminal accommodating portion)
23 . . . cavity
26, 90 . . . ventilation hole
27 . . . female terminal fitting
28 . . . one-piece rubber plug
29 . . . sealing hole
35, 95 . . . tubular fitting
53, 107 . . . wire cover
60 . . . ventilation member
61 . . . ventilation film
63 . . . holding portion
70 . . . tubular ventilation portion
83 . . . first cavity
84 . . . first female terminal fitting
89 . . . second cavity

The invention claimed is:

1. A waterproof connector, comprising:

a female housing configured to constitute a sealing space by being connected to a male housing;

a terminal accommodating portion of the female housing, including a plurality of cavities into which female terminal fittings are to be inserted, and to be fit into a receptacle of the male housing;

a tubular fitting constituting the female housing, arranged to surround the terminal accommodating portion, and to be fit to an outer periphery of the receptacle; and a ventilation member including a ventilation film enabling ventilation between the sealing space and an outside of the female housing, the ventilation member being arranged such that the ventilation film at least partially overlaps the receptacle in a virtual projection plane perpendicular to a connecting direction of the male housing and the female housing.

2. The waterproof connector of claim 1, wherein the ventilation member includes:

a holding portion for holding the ventilation film in a state oriented in a direction intersecting the connecting direction; and a tubular ventilation portion extending from the holding portion and communicating with the sealing space, a cross-sectional area of the tubular ventilation portion intersecting an extending direction being smaller than the ventilation film.

3. The waterproof connector of claim 2, wherein the tubular ventilation portion extends substantially parallel to the connecting direction and is arranged at a position eccentric from a center of the ventilation film.

4. The waterproof connector of claim 3, wherein the female housing is formed with a ventilation hole allowing communication between the sealing space and the tubular ventilation portion.

5. The waterproof connector of claim 4, further comprising:

a one-piece rubber plug formed with a plurality of penetrating sealing holes corresponding to the cavities is provided in the female housing; and the tubular ventilation portion penetrating through the one-piece rubber plug in an air-tight manner.

6. The waterproof connector according to any one of claim 5, wherein:

the ventilation member is exposed on a back surface of the female housing; and a wire cover for covering the back surface is mounted on the female housing.

* * * * *